United States Patent [19]

Aono et al.

[11] 4,034,727

[45] July 12, 1977

[54] AUTOMOTIVE ENGINE CARBURETOR

[75] Inventors: Shigeo Aono, Seki; Makoto Anzai, Yokosuka, both of Japan

[73] Assignee: Nissan Motor Co., Ltd., Yokohama, Japan

[21] Appl. No.: 643,125

[22] Filed: Dec. 22, 1975

[30] Foreign Application Priority Data

Dec. 24, 1974 Japan ..... 50-1419

[51] Int. Cl.[2] ..... F02B 33/00

[52] U.S. Cl. ..... 123/119 EC; 261/72 R; 261/DIG. 67; 261/DIG. 74

[58] Field of Search ..... 60/276, 285; 123/119 R, 123/119 EC; 261/72 R, DIG. 8, DIG. 67, DIG. 74

[56] References Cited

U.S. PATENT DOCUMENTS

| | | | |
|---|---|---|---|
| 1,329,309 | 1/1920 | Prentiss | 261/DIG. 67 |
| 1,906,982 | 5/1933 | Linga | 261/72 R |
| 3,345,045 | 10/1967 | Tuggle | 261/DIG. 8 |
| 3,730,157 | 5/1973 | Gerhold | 261/72 R |
| 3,921,612 | 11/1975 | Aono | 123/119 R |
| 3,974,813 | 8/1976 | Knapp | 261/DIG. 67 |

*Primary Examiner*—Douglas Hart

[57] ABSTRACT

A float bowl of an automotive engine carburetor is air-tightly covered by a diaphragm which is securely fixed to an electromagnetic transducer to be vibrated for controlling air pressure acting on the fuel being confined within the float bowl, whereby the amount of fuel delivered to the engine from the float bowl is controlled in dependence of the electrical signal applied.

7 Claims, 6 Drawing Figures

AUTOMOTIVE ENGINE CARBURETOR

This invention relates generally to an automotive engine carburetor, and more particularly to a carburetor for use with an electronic closed loop control system.

Various systems have been proposed to optimally control the air-fuel ratio of an air-fuel mixture to an internal combustion engine in dependence of the modes of engine operation, one of which is to utilize the concept of an electronic closed loop control system based on various informations such as, for example, a sensed concentration of a component in exhaust gases of the engine, an engine temperature at engine cold start, an engine speed, etc. A conventional carburetor, which is used with such a closed loop control system, is usually provided with various parts for optimally regulate the air-fuel mixture by accepting a signal representative of the informations. The various parts are such as an fuel pump for engine acceleration, a discharge nozzle for low engine speed, an air bleed chamber, an electromagnetic valve provided in an air passage, etc. In accordance with the prior art, therefore, the carburetor has been inevitably complicated in its structure.

The present invention is therefore directed to provide an improved carburetor with simple structure or mechanism as compared with the conventional one.

According to the present invention, in brief, an automotive engine carburetor comprises: a venturi; a float bowl for confining fuel therein; a fuel passage provided between the float bowl and the venturi; a diaphragm providing an air sealing covering for the float bowl; and means responsive to an electrical signal applied thereto driving the diaphragm in order to control the air pressure acting on the fuel confined within the float bowl so as to regulate the amount of fuel sucked into the venturi through the fuel passage.

It is therefore an object of the present invention to provide a carburetor with simple structure or mechanism which is used with an electronic closed loop control system for optimally regulating the amount of fuel delivered to the engine, the carburetor comprising improved means which controls air pressure on fuel confined within a float bowl.

Figure 1:
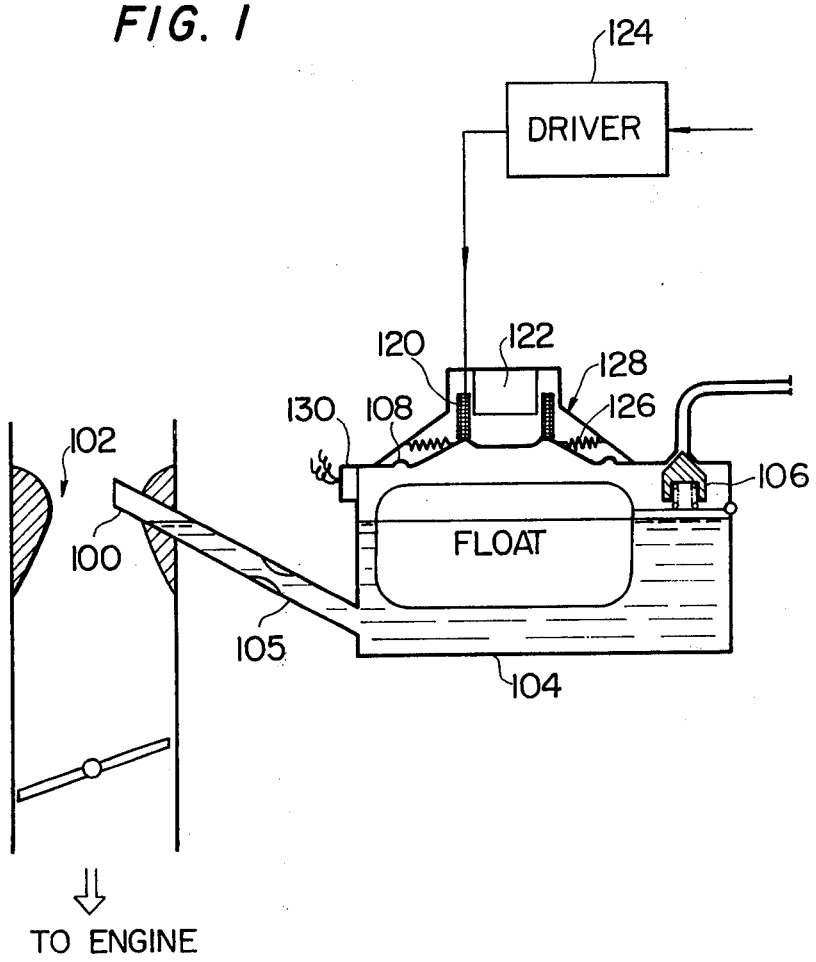
Figure 2:
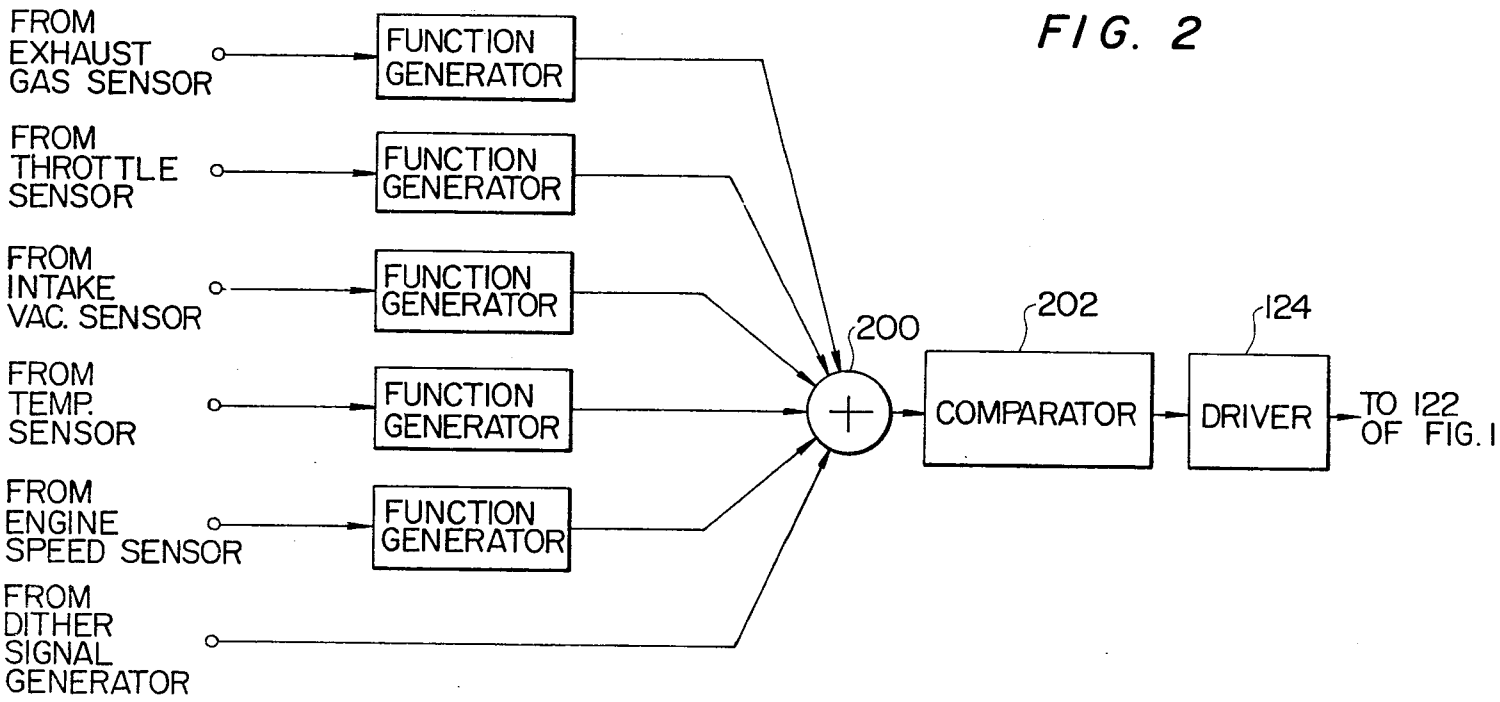
Figure 3A:
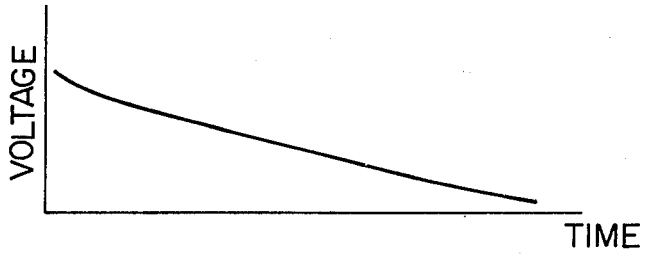
Figure 3B:
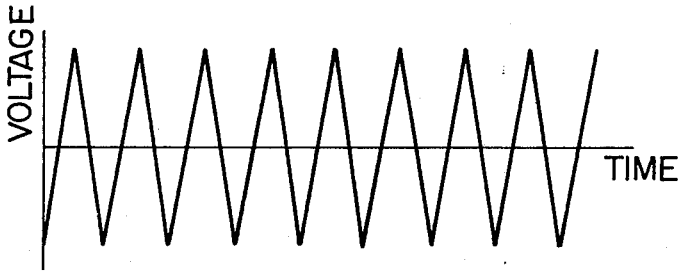
Figure 3C:
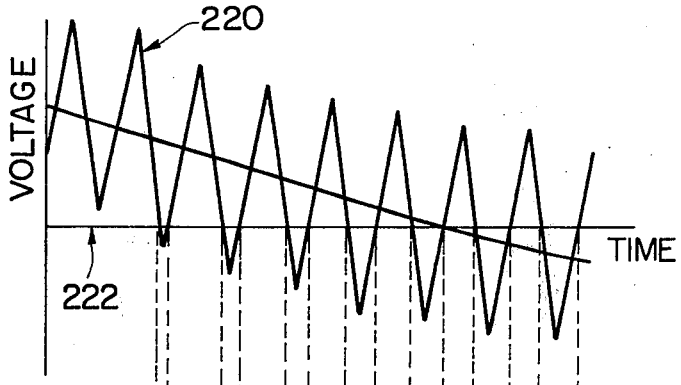
Figure 3D:
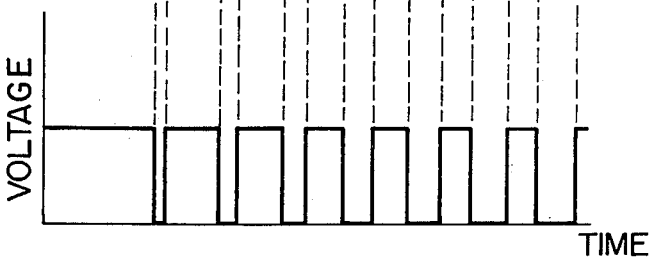

This and other objects, features and many of the attendant advantages of this invention will be appreciated more readily as the invention becomes better understood by the following detailed description, wherein:

FIG. 1 schematically illustrates a preferred embodiment of the present invention;

FIG. 2 schematically illustrates a part of conventional electronic closed loop control system for use with the FIG. 1 embodiment; and FIGS. 3*a*–3*d* shows several waveform developed at or derived from several elements of the FIG. 2 system.

Reference is now made to the drawings, first to FIG. 1, wherein a preferred embodiment of the present invention is schematically illustrated. A discharge nozzle 100 is projected into a venturi 102 within a mixture induction pipe 111 and communicates with a float bowl 104 through a fuel passage 105. As is well known, the amount of fuel delivered to an internal combustion engine (not shown) is determined by a difference in pressure between the venturi 102 and the float bowl 104. The fuel is pumped from a fuel tank (not shown) into the float bowl 104 through a conventional valve assembly 106. The float bowl 104 is airtightly covered by a diaphragm 108 which is securely fixed to a moving oil 120. The moving coil 120 surrounds a magnet 122 and reciprocally movable in response to an electrical signal applied thereto from a driver stage 124, so that the diaphragm 108 is also reciprocally moved in accordance with the movement of the coil 120.

It is therefore understood that the pressure acting on the fuel within the float bowl 104 is controlled by the movements of the diaphragm 108 in response to the electrical signal applied to the coil 120. The signal is generated on the basis of various engine operation modes in order to optimally supply an airfuel mixture into combustion chambers (not shown), in other words, the signal represents an optimum amount of fuel being sucked into the mixture induction pipe 111 in accordance with the engine operation modes required. The signal from the driver 124 usually takes the form of a pulse train, and the vibrations of the diaphragm 108 is controlled by changing a time duration of each of pulses. However, a continuous change in magnitude of the signal is also applicable for controlling the vibrations of the diaphragm 108. As shown, a damper 126 is provided between a diaphragm housing 128 and the diaphragm 108 for damping vibrations of the diaphragm 108 in order that pulsating vibrations thereof may be reduced to a desirable extent. In the above, a moving magnet type is also acceptable to vibrate the diaphragm 108 in substitution for the socalled moving coil type. As is well known, a conventional carburetor, in order to ensure an optimum supply of an air-fuel mixture to the engine under different engine operation modes, comprises various parts such as an acceleration fuel pump, a discharge nozzle for idling, an air bleed chamber, and a choke, etc. However, the embodiment of the present invention is dispensable with some or all of the above-mentioned various parts provided that the signal from the driver 124 is accurately controlled. Therefore, in accordance with the present preferred embodiment, the conventional carburetor can be simplified in structure, reduced in size, and lowered in manufacturing cost, etc. Furthermore, the embodiment of the present invention can be installed in a conventional carburetor, in the case of which an electromagnetic valve 130 is provided as shown in FIG. 1. The valve 130 is opened in response to a control signal applied thereto to allow the inside of the float bowl 104 to communicate with atmosphere, wherein a conventional carburetor operation is performed. In addition to the above, the operation of the valve 130 can be designed to open or close in response to electrical signal applied thereto from, for example, the driver 124 through a suitable interface in order to optimally regulate, together with the operation of the diaphragm 108, the rate of fuel flow to the nozzle 100 in due consideration of pressure of the fuel pump (not shown), pressure acting on the fuel in the fuel bowl 104, capacity of the fuel bowl 104, etc. On the other hand, the valve 130 is closed in response to the signal applied thereto for carrying more accurately and desirably the operation of the conventional carburetor.

Reference is now made to FIGS. 2 and 3, wherein there is schematically illustrated an example of a conventional electronic closed loop control system for use with the FIG. 1 embodiment. As shown in FIG. 2, an adder 200 receives, through a plurality of suitable function generators, various signals from various conventional sensors such as a throttle opening sensor, an intake vacuum sensor, a coolant or engine temperature sensor, an exhaust gas sensor such as an oxygen sensor, and an engine speed sensor, although they are not shown. The resultant signal of the above-mentioned various ones is schematically depicted in FIG. 3*a*. In addition, a dither signal, the waveform of which is illustrated in FIG. 3*b*, is also applied to the adder 200 from a dither signal generator (not shown) and then added to the resultant signal as shown in FIG. 3*a*. The output signal of the adder 200 is illustrated by reference number 200 in FIG. 3*c*. The output signal is then fed to the next stage, viz., a comparator 202, and compared with a predetermined reference value 222 (FIG. 3*c*) to generate a train of pulses (FIG. 3*d*). The reference value is previously determined in due consideration of, for example, an optimum ratio of an air-fuel mixture to the engine for maximizing the efficiency of a catalytic converter such as, for example, a so-called three-way catalytic converter, etc. The train of pulses from the comparator 202 is fed to the driver 124 which serves to amplify the incoming pulsating signal to such an extent that the diaphragm 108 is effectively vibrated. The amplified pulsating signal is then applied to the coil 120 (FIG. 1). In the above, the comparator 202 can be substituted by a differential signal generator, and furthermore the driver 124 is not necessarily required in the closed loop control system on condition that the magnitude of the output signal from the comparator 202 is sufficiently large to drive the diaphragm 108. Still furthermore, the dither signal generator (not shown) can be coupled to the comparator 202 in substitution for the adder 200 for applying the dither signal thereto for a reference value, in the case of which the reference value 222 (FIG. 3*c*) is no longer employed.

In the above, since the frequency of the dither signal (FIG. 3*b*) is usually constant, a v-f (voltagefrequency) converter may be interposed between the driver 124 and the coil 120 in order to even more accurately control the air-fuel mixture ratio by changing the vibrating period of the diaphragm 108.

From the foregoing, it is understood that, in accordance with the present invention, the conventional carburetor for use with the electronic closed loop control system is considerably simplified in structure with accurate regulation of the air-fuel mixture under various engine operation modes.

It is apparent that various modifications may be made in the illustrated embodiment of the present invention within the intended scope of the invention as set forth in the hereinafter appended claims.

What is claimed is:

1. An automotive engine carburetor comprising:

a venturi;

a float bowl for confining fuel therein;

a fuel passage provided between said float bowl and said venturi;

a diaphragm covering said float bowl providing an airtight seal therefor; and means responsive to an electrical signal applied thereto driving said diaphragm in order to control the pressure acting on the fuel being confined within said float bowl so as to regulate the amount of fuel sucked into said venturi through said fuel passage.

2. An automotive engine carburetor as claimed in claim 1, wherein the magnitude of said electrical signal depends on an electrical signal derived from an exhaust gas sensor provided in an exhaust gas pipe.

3. An automotive engine carburetor as claimed in claim 1, further comprising means for damping vibrations of said diaphragm.

4. An automotive engine carburetor as claimed in claim 1, wherein said means comprises, a coil assembly securely fixed to a fixed member and disposed in the vicinity of said coil assembly in a manner to cause a relative movement therewith upon said electrical signal being applied to said coil assembly.

5. An automotive engine carburetor as claimed in claim 1, wherein said means comprises, a magnet securely fixed to said diaphragm, and a coil assembly securely fixed to a fixed member and disposed in the vicinity of said magnet in a manner to cause a relative movement therewith upon said electrical signal being applied to said coil assembly.

6. An automotive engine carburetor as claimed in claim 3, further comprising means for allowing said float bowl to communicate with the atmosphere.

7. An automotive engine carburetor as claimed in claim 6, wherein said means for allowing said float bowl to communicate with the atmosphere is an electromagnetic valve.

* * * * *